United States Patent [19]

Lemoine

[11] Patent Number: 4,989,730

[45] Date of Patent: Feb. 5, 1991

[54] COTTON SWAB SHIPPING CONTAINER AND DISPENSER

[76] Inventor: Philippe Lemoine, 50 Rue Saint Ferdinand, 750/7 Paris, France

[21] Appl. No.: 345,778

[22] Filed: May 1, 1989

[51] Int. Cl.[5] ..... B65D 83/02

[52] U.S. Cl. ..... 206/362; 206/628; 206/634; 206/815; 221/302; 221/303

[58] Field of Search ..... 206/362, 370, 628, 634, 206/620, 815; 221/303, 312 R, 309, 310, 302; 312/73; 229/122, 122.1, 122.2; 220/356, 362

[56] References Cited

U.S. PATENT DOCUMENTS

| | | | |
|---|---|---|---|
| 897,789 | 9/1908 | Schneiber | 312/73 |
| 2,606,708 | 8/1952 | Irvan | 220/356 |
| 3,164,298 | 1/1965 | Repko | 229/122.1 |
| 3,207,411 | 9/1965 | Farquhar | 206/628 |
| 3,262,632 | 7/1966 | Brady et al. | 220/269 X |
| 3,301,391 | 1/1967 | Guyer | 206/362 |
| 4,202,464 | 5/1980 | Mohs et al. | 206/634 X |
| 4,236,637 | 12/1980 | Castner, Sr. et al. | 206/362 X |

FOREIGN PATENT DOCUMENTS

| | | | |
|---|---|---|---|
| 2048218 | 12/1980 | United Kingdom | 206/362 |

*Primary Examiner*—Paul T. Sewell
*Assistant Examiner*—Jacob K. Ackon, Jr.

[57] ABSTRACT

A plastic shipping container for cotton swabs that has a T-section at the bottom of the container front panel that at the shipping destination is readily removed to form a dispensing opening for the cotton swabs.

1 Claim, 2 Drawing Sheets

COTTON SWAB SHIPPING CONTAINER AND DISPENSER

The present invention relates generally to improvements in the use of cotton swabs, and more particularly to a cotton swab container which effectively serves both as a shipping or storage container and, at the point of use, as a dispenser for the cotton swabs stored therein.

EXAMPLE OF THE PRIOR ART

In U.S. Pat. No. 3,164,298 issued on Jan. 5, 1965 to Repko, dispensing packages are disclosed of both cardboard and plastic construction material. The cardboard packages are readily converted into dispensers, but this construction material is not adequate to protect the product contents during shipment. In the embodiment of this patent which is made of plastic, such as that shown in FIGS. 1–9, to function as a dispenser the embodiment is provided with a bottom opening 46 which is not closed, and therefore the dispenser cannot function as a shipping container, and to remove the contents, the procedure illustrated in FIGS. 4–9 must be followed. This procedure contemplates pulling each dispensed item downwardly (see FIG. 8) which, of course, would not be appropriate for cotton swabs.

In accordance with the present invention, a supply of cotton swabs is contained within a closed package formed of sufficiently rigid plastic to provide protection during shipment, and at the point of use, a section of the package panel is constructed to be readily removed to provide in the area it occupied an access opening for facilitated removal of the cotton swabs. More particularly, the removal of the access opening section is designed by its structural features to be achieved by finger manipulation of the user, and thus withstands inadvertent removal as otherwise might result from normal abuse during shipment of the package.

The description of the invention which follows, together with the accompanying drawings should not be construed as limiting the invention to the example shown and described because those skilled in the art to which this invention appertains will be able to devise other forms thereof within the ambit of the appended claims.

Figure 1:
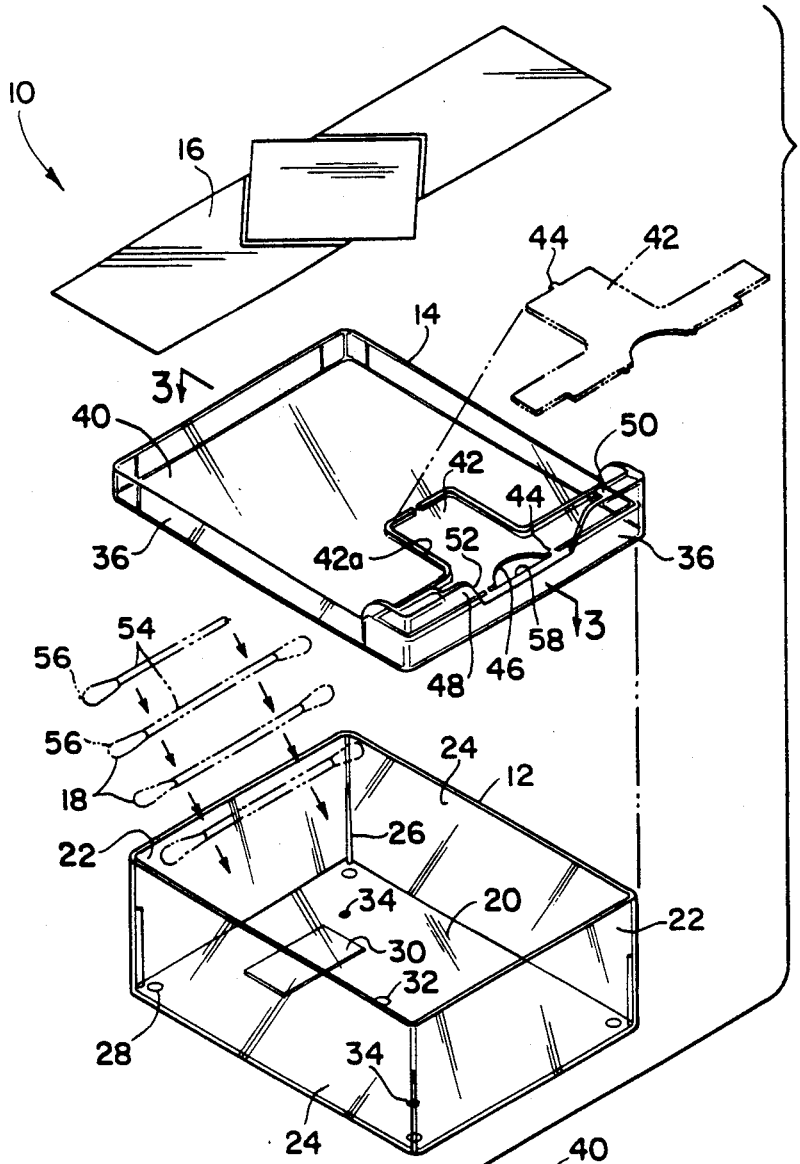
FIG. 1 is an isometric exploded view of the components of the inventive cotton swab combination shipping and dispensing device.
Figure 2:
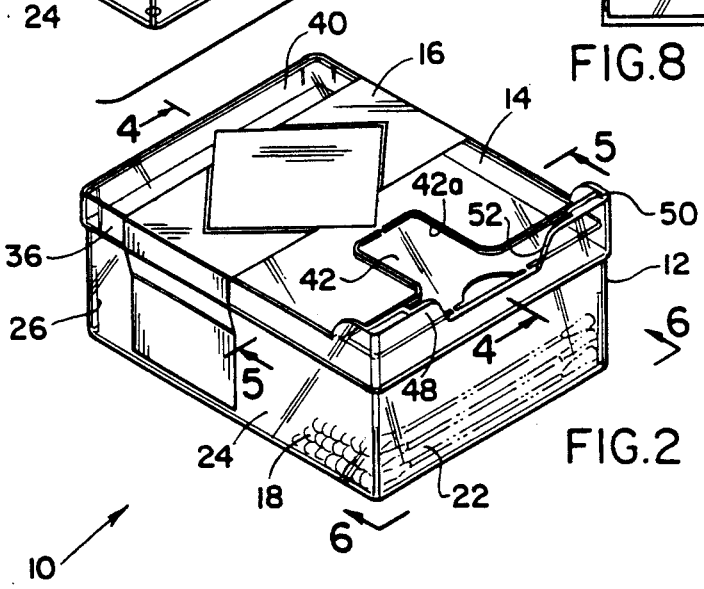
FIG. 2 is an isometric assembled view of the device.

The components of the assembled combination shipping container and dispenser 10 for cotton swabs is shown in FIG. 2, and the same components are shown in disassembled or spaced relation in FIG. 1.

The device body is a boxlike member 12 that is made to contain a designated number of product members, which in the end use herein described are specifically double tipped cotton swabs 18. In this specific example, box 12 is sized to contain 200 individual cotton swabs 18 stacked in "honeycomb" fashion before cover 14 is applied. Cover member 14 cooperates with box 12 to form container 10 when an adhesive label strap 16 is used as a seal, as best shown in FIGS. 2, 4 and 5.

Using the well known injection molding technique, in a single or multiple cavity mold, each device 10 receives via a molding sprue (denoted as 32 in FIG. 1) clear plastic construction material which forms each box member 12 with a bottom 20, a pair of top and bottom end panels 22, as well as opposite side panels 24. Each inside corner is made in practice with a reinforcing rib or web 26. As thusly formed and because of the use of clear plastic construction material, the device 10 when filled with cotton swabs 18, functions effectively as a shipping container maintaining the cotton swabs intact and protected against damage during the shipment. Also, and as will be described subsequently, the device 10 at its destination and point of use, is then readily and effectively also used as a dispenser for the cotton swabs, wherein each cotton swab 18 is removed therefrom, usually one at a time, from the stored supply within the box 12.

Figure 8:
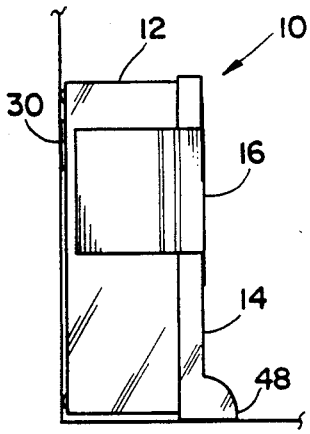
Figure 4:
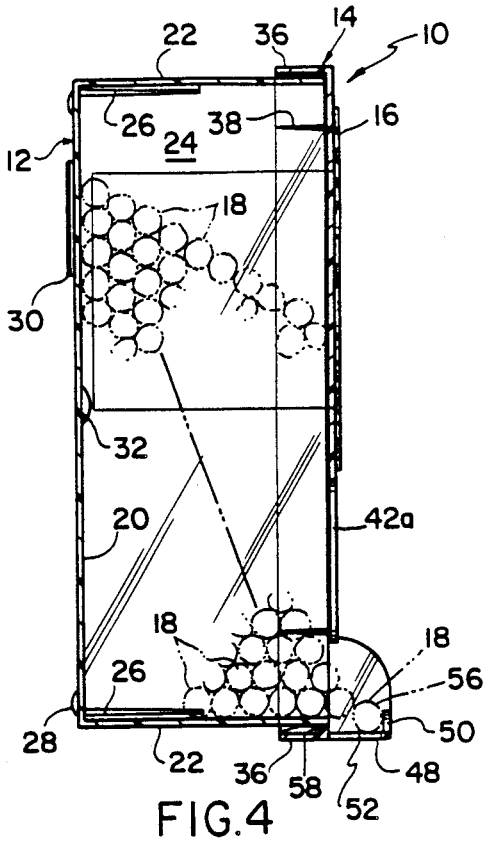
FIG. 4 is a side elevational view in cross section as taken along line 4—4 of FIG. 2, with the access panel of the device removed to facilitate exiting movement of the cotton swab contents.
Figure 5:
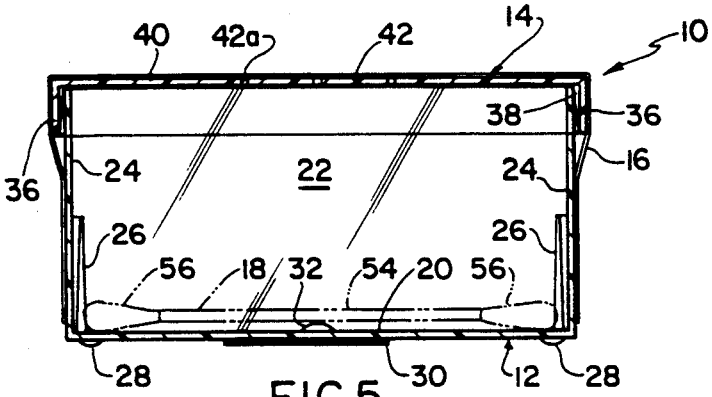
FIG. 5 is a cross sectional view of the device as taken along line 5—5 of FIG. 2.
Figure 6:
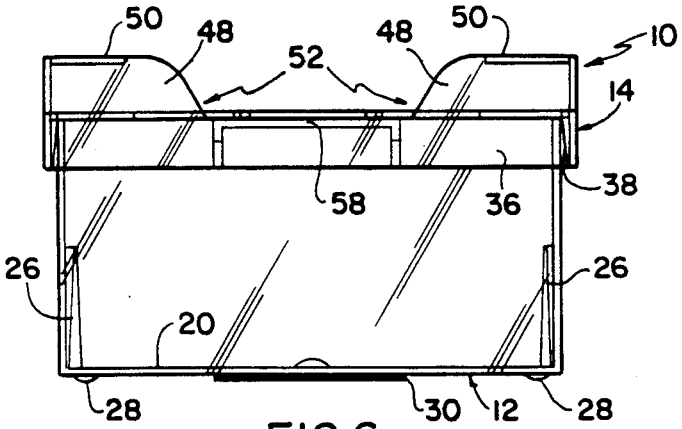
FIG. 6 is an end elevational view as taken along line 6—6 of FIG. 2 showing further structural details.

To facilitate the dispensing function of the device 10, the outside surface of bottom panel 20 is formed with a set of corner protrusions 28, as best seen in FIGS. 4 and 5, and centrally is provided with at least one pealable adhesive patch 30, so as to be readily attached in a vertical orientation to a support surface as shown in FIG. 8. For added convenience, a pair of mounting holes 34 are also made available for use in completing an attachment to a vertical support surface.

Cover 14 is generally rectangular with a dependent lip 36 that is slightly oversized with respect to the opening of box 12 so that the lip 36 overlaps the sides of the box 12. The overlapping surface of lip 36 has small wedge ribs 38 for reinforcement and guidance of cover 14 against box 12.

Figure 3:
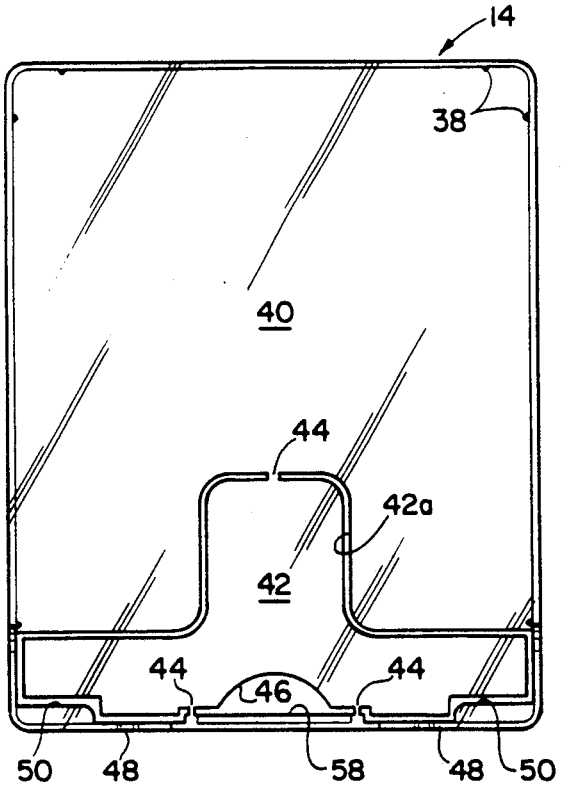
FIG. 3 is a detailed plan view of the cover member of the device as seen along line 3—3 of FIG. 1.

For converting from the shipping container to the dispensing function of the device 10, the flat panel 40 of cover 14, at its bottom end, as best seen in FIG. 3, is made with a removable "T" shaped panel 42 which during shipment is rigidly supported by three breakaway bridges 44. To facilitate its removal preparatory to use of device 10 as a dispenser, panel 42 is provided with a grip cutaway 46. Also, and specifically in accordance with the present invention, the finger grip 46 is provided in recognition that finger manipulation is required by the user to release or remove panel 42, and thus the breakaway force to rupture the bridges 44 is selected to be of an extent to obviate inadvertent rupture of the bridges 44 as might result from normal abuse of the device 10 during shipment. Along its width and immediately adjacent panel 42, a two part dispensing lip 48 is provided on cover 14. Lip 48, to be used when unit 10 is in its "vertical" position, is fitted with swab stop members 50 and a finger clearance area 52 for finger-gripping each swab 18 when removing same. Lip 48 also has the additional function, because of its advantageous location both adjacent to, and protruding forward of, the removal panel 42, of obviating contact against panel 42 during shipment as might result in premature rupture of the bridges 44. Lip 36, has a reinforcing wall 58 in the vicinity of clearance area 52 on cover 14 to confine the access opening 42*a* to the area occupied by the panel 42. After box 12 is filled with swabs 18, cover 14 is placed thereon and sealed in place with the previously noted adhesive coated label strip 16, as shown in FIG. 2. Assembly 10 at this point thus serves as a shipping container and, subsequently as a dispenser unit, as will now be explained.

Figure 7:
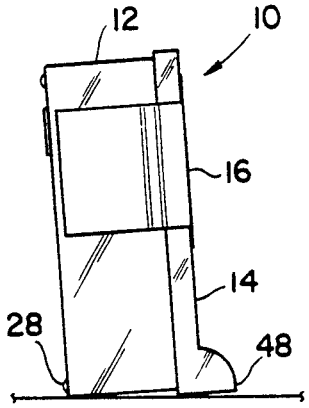
FIGS. 7 and 8 are side elevational views showing typical end uses of the device as a cotton swab dispenser.

At the point of use, the user has the option of utilizing unit 10 in the horizontal position of FIG. 2, or in the preferred vertical positions illustrated in FIGS. 7 and 8. When device 10 is in its FIG. 2 horizontal position, the user may cut one or both side flaps of seal strip 16 and lift cover 14 whenever it is desired to obtain one or more swabs 18. Box 12 will rest on glides 28 and can, if desired, be anchored to a horizontal surface using the adhesive patch 30.

In the preferred vertical position use of the device 10, it is contemplated that the user obtain access to the swabs 18 by prying panel 42 with a thumbnail or convenient tool at cutaway 46 until the breakaway bridges 44 yield. Removal of panel 42 provides an access opening 42*a* of corresponding size in the area previously occupied by panel 42 and swabs 18 are now accessible through this access opening 42*a* for ready grasping by the user's thumb and forefinger.

Assembly 10 is designed primarily for vertical position use, and after panel 42 has been removed from cover 14, box 12 may be free standing on end 22 as shown in FIG. 7. Alternately, and as shown in FIG. 8, assembly 10, with panel 42 again removed, may also be placed against a vertical wall, such as in a medicine cabinet, and secured in place using an adhesive patch 30. In either circumstance, gravity movement of the swabs 18 automatically occurs to the lip 48. Swabs 18 have a shaft 54 and tips 56 which advance against stop members 50. Clearance area 52 allows for easy grasping of shaft 54 for removal of each swab 18. As each swab 18 is removed from its spanning position across the lips 48, another of the swabs 18 will successively move into place thereon until the supply is exhausted.

Reuse of dispenser 10 is also contemplated, wherein it is adapted to be permanently mounted with suitable hardware (not shown) using holes 34, and in its mounted position, provided with convenient refill swab packs as required.

While the particular cotton swab container herein shown and disclosed in detail is fully capable of attaining the objects and providing the advantages hereinbefore stated, it is to be understood that it is merely illustrative of the presently preferred embodiment of the invention and that no limitations are intended to the detail of construction or design herein shown other than as defined in the appended claims.

What is claimed is:

1. For use with cotton swabs, a combination shipping container and dispenser comprising a hollow rectangular body of plastic construction material having a removable front panel, said front panel fastened to said body by selectively removable attachment means, a removable portion in the lower end of said front panel consisting of a T-shape having a top which is located proximate the edge of said panel, delineated in said front panel by a groove except for a selected number of connecting bridges therebetween at spaced intervals along said groove, a fingergrip opening in the top portion of said T-shape to facilitate the gripping thereof incident to the rupturing of said connecting bridges, and a pair of lips in adjacent position to the top of said T-shape and extending laterally of said front panel so as to obviate contact against said T-shape as might cause the inadvertent detachment thereof during shipment of said cotton swabs, said lips located beyond the corresponding margin of said body, and being clear of the horizontal extend of the top portion of said T-shape to facilitate finger access to the central portion of the dispensed swabs, whereby the removal of said T-shape provides an access opening to the cotton swabs stored in said body and covers said body from a shipping container to a cotton swab dispenser.

* * * * *